US006947682B2

(12) United States Patent
Kosugi et al.

(10) Patent No.: US 6,947,682 B2
(45) Date of Patent: Sep. 20, 2005

(54) IMAGE FORMING APPARATUS FOR REDUCING TONER SCATTER

(75) Inventors: Hideki Kosugi, Kanagawa (JP); Sadayuki Iwai, Kanagawa (JP); Tomoko Takahashi, Kanagawa (JP); Masako Yoshii, Kanagawa (JP); Ayako Iino, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 75 days.

(21) Appl. No.: 10/625,521

(22) Filed: Jul. 24, 2003

(65) Prior Publication Data

US 2004/0218940 A1 Nov. 4, 2004

(30) Foreign Application Priority Data

Jul. 31, 2002 (JP) ..... 2002-223400

(51) Int. Cl.[7] ..... G03G 15/16

(52) U.S. Cl. ..... 399/66; 399/297; 399/302; 399/308

(58) Field of Search ..... 399/66, 296–319

(56) References Cited

U.S. PATENT DOCUMENTS

| | | | | | |
|---|---|---|---|---|---|
| 4,736,227 | A | * | 4/1988 | Till et al. | 399/296 |
| 5,619,316 | A | | 4/1997 | Shoji et al. | |
| 5,740,494 | A | | 4/1998 | Shoji et al. | |
| 5,740,508 | A | * | 4/1998 | Matsuura et al. | 399/308 |
| 5,765,087 | A | | 6/1998 | Yano et al. | |
| 5,809,388 | A | | 9/1998 | Inada et al. | |
| 5,864,737 | A | | 1/1999 | Obu et al. | |
| 5,923,930 | A | | 7/1999 | Tsukamoto et al. | |
| 5,940,668 | A | * | 8/1999 | Tanigawa et al. | 399/302 |
| 5,970,296 | A | * | 10/1999 | Takase | 399/310 |
| 5,987,281 | A | | 11/1999 | Kurotori et al. | |
| 5,987,282 | A | | 11/1999 | Tsukamoto et al. | |
| 5,999,773 | A | | 12/1999 | Yasutomi et al. | |
| 6,115,576 | A | | 9/2000 | Nakano et al. | |
| 6,347,212 | B1 | | 2/2002 | Kosugi et al. | |
| 6,422,696 | B1 | | 7/2002 | Takahashi et al. | |
| 6,460,973 | B1 | | 10/2002 | Takahashi et al. | |
| 6,611,672 | B2 | | 8/2003 | Aoki et al. | |

FOREIGN PATENT DOCUMENTS

| | | | | | |
|---|---|---|---|---|---|
| JP | 04098278 | A | * | 3/1992 | G03G/15/16 |
| JP | 7-20726 | | | 1/1995 | |
| JP | 8-30119 | | | 2/1996 | |
| JP | 08272222 | A | * | 10/1996 | G03G/15/16 |
| JP | 10282798 | A | * | 10/1998 | G03G/15/14 |
| JP | 2000-19854 | | | 1/2000 | |
| JP | 2003057963 | A | * | 2/2003 | G03G/15/16 |

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

An image forming apparatus of the present invention includes an image carrier on which a toner image is to be formed, and a sheet support member for conveying a sheet, carrying the toner image thereon, in cooperation with the image carrier. The image carrier and sheet support member are driven such that their surfaces move in the same direction, as seen at a contact position where the two surfaces face each other via the sheet. An electric field, forcing the toner image toward the image carrier, and an electric field, forcing it toward the sheet, are formed between the surface of the image carrier and that of the sheet at positions upstream and downstream, respectively, of the contact position in the direction of movement of the sheet.

21 Claims, 6 Drawing Sheets

| | CONVENTIONAL | INVENTION (FIG. 5) |
|---|---|---|
| SHAPNESS | 0.36 | 0.54 |
| TONALITY | 0.922 | 0.961 |
| GRANULARITY | 0.45 | 0.33 |

IMAGE FORMING APPARATUS FOR REDUCING TONER SCATTER

BACKGROUND OF THE INVENTION

1. Field of the Invention

The present invention relates to an electrophotographic image forming apparatus and more particularly to an image forming apparatus capable of effectively coping with toner scattering and defective image transfer to occur when a toner image is transferred from a photoconductive element, intermediate image transfer body or similar image carrier to a sheet or recording medium.

2. Description of the Background Art

Today, various image forming systems are available with a printer or similar image forming apparatus. A direct image transfer system, for example, develops a latent image formed on a photoconductive element with toner and directly transfers the resulting toner image to a sheet. An intermediate image transfer system transfers a plurality of toner images of different colors to an intermediate image transfer body one above the other to thereby form a composite color image and then transfers the composite color image to a sheet.

When the toner image is transferred from the photoconductive element, intermediate image transfer body or similar image carrier to a sheet, it is likely that the toner image is degraded by some different causes, particularly toner scattering. Toner scattering refers to an occurrence that a toner image is not transferred to an expected position, but is scattered therearound and blurred thereby. Particularly, toner scattering lowers the sharpness of line images. More specifically, toner is transferred from the photoconductive element or the intermediate image transfer body to a sheet by an electric field formed at the inlet of a nip for image transfer, i.e., pretransfer as generally referred to. Further, when discharge occurs at, e.g., the inlet of the nip, the amount of charge (Q/M) of the toner decreases with the result that the Coulomb force, acting between toner grains, overcomes electrostatic adhesion, aggravating toner scattering. Various schemes have heretofore been proposed for reducing toner scattering.

For example, Japanese Patent Laid-Open Publication No. 9-236992 proposes to cause a sheet to contact a photoconductive element at a position upstream of an image transfer position (pre-contact), so that a toner image is protected from disturbance ascribable to discharge occurring at the inlet of a nip. In practice, however, it is extremely difficult to effect stable pre-contact at all times. More specifically, because flexibility of a sheet, for example, depends on environmental conditions and the kind of a sheet, it is likely that a toner image is rubbed when a sheet, carrying the toner image thereon, enters the nip.

As for primary image transfer from a photoconductive element to an intermediate image transfer body, Japanese Patent Laid-Open Publication No. 8-30119 teaches that toner scattering can be reduced if a bias of the same polarity as toner and a bias opposite in polarity to toner are applied at the upstream side and downstream side of a nip, respectively. This document, however, does not address to the dependence of a sheet on environmental conditions, which is a problem particular to secondary image transfer, and cannot be directly applied to secondary image transfer.

Technologies relating to the present invention are also disclosed in, e.g., Japanese Patent Laid-Open Publication Nos. 7-20726 and 2000-19854.

SUMMARY OF THE INVENTION

It is an object of the present invention to provide an image forming apparatus capable of protecting image quality from degradation ascribable to toner scattering and defective image transfer occurring in the event of transfer of a toner image from an image carrier to a paper sheet or similar sheet.

An image forming apparatus of the present invention includes an image carrier on which a toner image is to be formed, and a sheet support member for conveying a sheet, carrying the toner image thereon, in cooperation with the image carrier. The image carrier and sheet support member are driven such that their surfaces move in the same direction, as seen at a contact position where the two surfaces face each other via the sheet. An electric field, forcing the toner image toward the image carrier, and an electric field, forcing it toward the sheet, are formed between the surface of the image carrier and that of the sheet at positions upstream and downstream, respectively, of the contact position in the direction of movement of the sheet.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
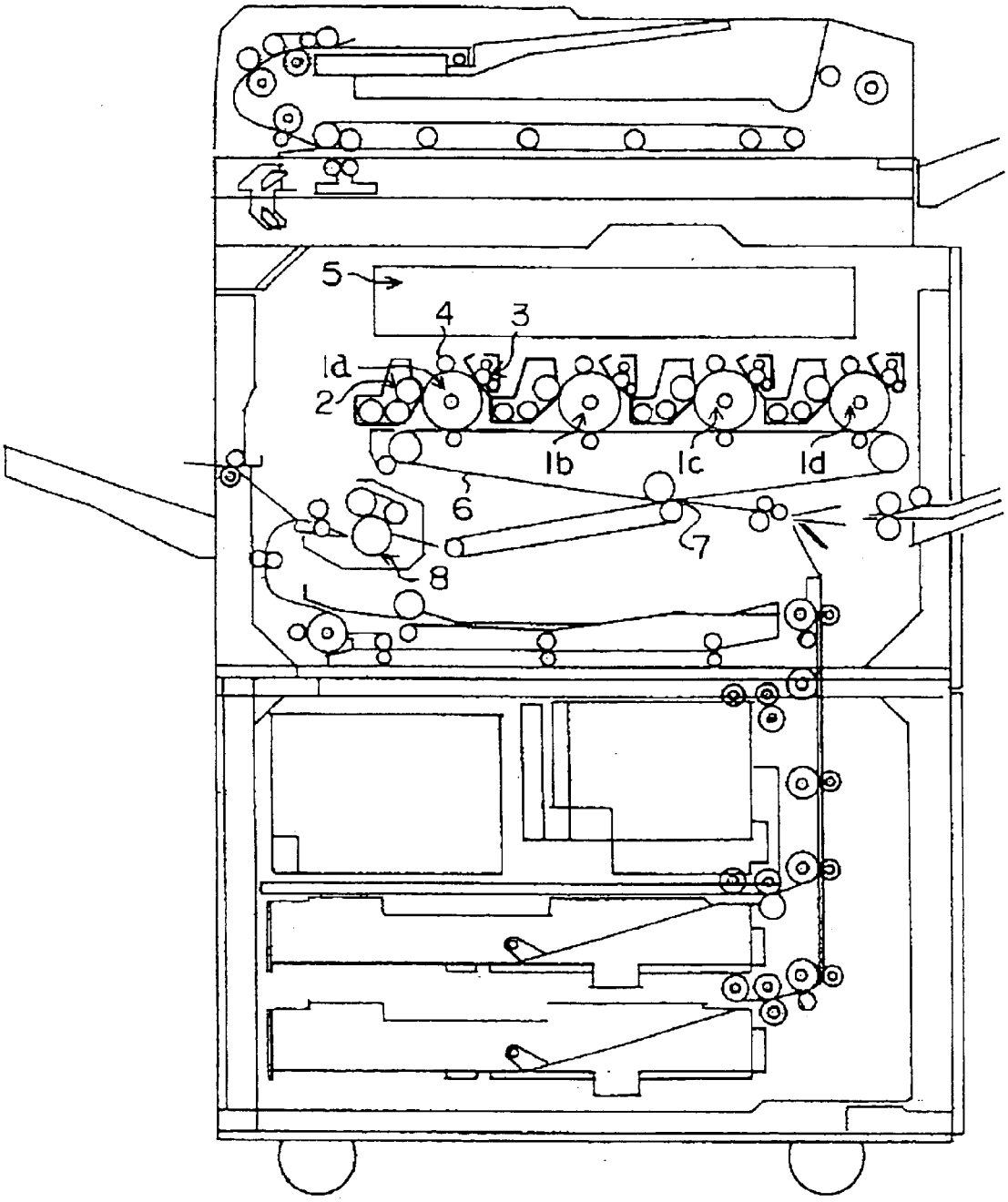
FIG. 1 is a view showing an image forming apparatus embodying the present invention.

Referring to FIG. 1 of the drawings, an image forming apparatus embodying the present invention is shown and implemented as a color image forming apparatus by way of example. As shown, the image forming apparatus includes four photoconductive drums 1*a*, 1*b*, 1*c* and 1*d* arranged side by side. Each photoconductive drum is a specific form of a photoconductive element or image carrier. Because image forming sections arranged around the drums 1*a* through 1*d* are identical with each other, let the following description concentrate on the image forming section assigned to the drum 1*a* by way of example.

The image forming section assigned to the drum 1*a* includes a developing unit 2, a drum cleaner 3, and a charger 4. An optical writing unit 5 is located above the image forming section. A toner image formed on the drum 1*a* is transferred to an intermediate image transfer belt (simply belt hereinafter) 6. Subsequently, toner images are sequentially transferred from the other drums 1*b* through 1*d* to the belt 6 over the toner image present on the belt 6, completing a full-color image. The full-color image is transferred from the belt 6 to a sheet at an image transfer position 7. Thereafter, the toner image is fixed on the sheet by a fixing unit 8.

Systems and conditions particular to consecutive image forming steps will be described hereinafter. The drums 1*a* through 1*d* each are charged to about −700 V at its non-image portion by a non-contact roller type of charging system. A laser diode included in the writing unit 5 scans the charged surface of each drum 1 to thereby form a latent image on the drum 1. Subsequently, the developing unit 2 develops the latent image for thereby forming a corresponding toner image.

The present invention is practicable with any kind of toner and any kind of developing system. For example, as for magnetic single-component toner is used, there may be used a BMT (Bipolar Magnetic Toner) system that charges toner grains by friction acting between the toner grains and conveys the toner grains thus charged to a developing zone with a magnet roller and a sleeve. Alternatively, use may be made of a jumping system that conveys a thin toner image formed on a developing sleeve toward a photoconductive element and causes toner grains to fly to the photoconductive element with an AC bias. As for nonmagnetic toner, use may be made of an NSP (Non-magnetic Single-component development Process) system that conveys toner to a developing zone with a conductive developing roller or a developing roller with an insulated surface or a nonmagnetic toner jumping system. Further, as for a two-component developer made up of toner and carrier, use maybe made of, e.g., a magnet brush development system.

In any case, the toner images formed on the drums 1*a* through 1*d* are sequentially transferred to the intermediate image transfer belt 6 one above the other. Experiments were conducted with a belt implemented as a seamless belt molded with a polyvinylidene fluoride resin film sheet and provided with volumetric resistance of 8E9 Ω·cm. 1,300 V subject to constant voltage control was applied as a bias for primary image transfer.

The belt is, in many cases, implemented by a PET (polyethylene terephthalate) film sheet, a polyurethane film sheet or similar film formed of dielectric resin. An adequate bias, of course, depends on the material and resistance of the belt. Primary transfer from the photoconductive drums 1*a* through 1*d* to the belt 6 is effected in the order of Y (yellow), M (magenta), C (cyan) and K (black). The resulting full-color image is transferred to a sheet at the secondary image transfer position 7. The belt 6, constituting an intermediate image transfer body, may be replaced with a roller or even with a corona charger, if desired.

Figure 2:
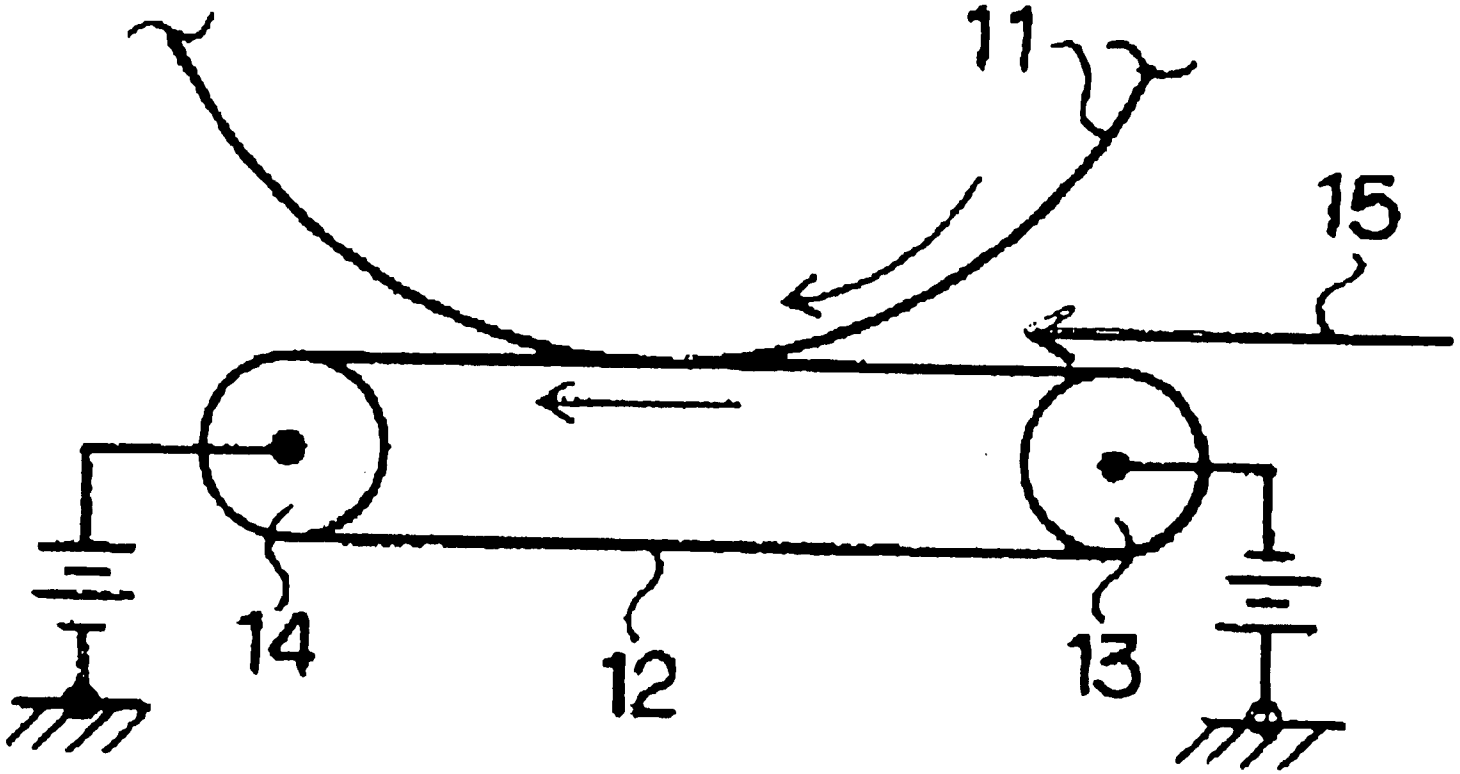
FIG. 2 is a view showing a specific configuration of an image transferring section included in the illustrative embodiment.

In the construction shown in FIG. 1, discharge or pre-transfer is not avoidable when a sheet enters the image transferring section. FIG. 2 shows a specific configuration of the image transferring section included in the illustrative embodiment and configured to reduce toner scattering ascribable to the above occurrence. As shown, an image transfer belt 12 faces and contacts an image carrier 11, which is either one of a photoconductive element and an intermediate image transfer body, and is passed over a first and a second bias roller 13 and 14.

When use is made of negatively charged toner, a bias of the same polarity as the toner, i.e., negative polarity is applied to the first bias roller 13 positioned upstream of a nip for image transfer. As a result, an electric field, forcing toner toward the image carrier 11, is formed between a sheet or recording medium 15 and the surface of the image carrier 11 upstream of the nip, reducing pretransfer to the sheet 15. On the other hand, a bias opposite in polarity to the toner, i.e., a bias of positive polarity is applied to the second bias roller 14 positioned downstream of the nip, forming an electric field that forces the toner toward the sheet 15 between the surface of the image carrier 11 and the sheet 15. Consequently, the toner is transferred from the image carrier 11 to the sheet 15.

Figure 3:
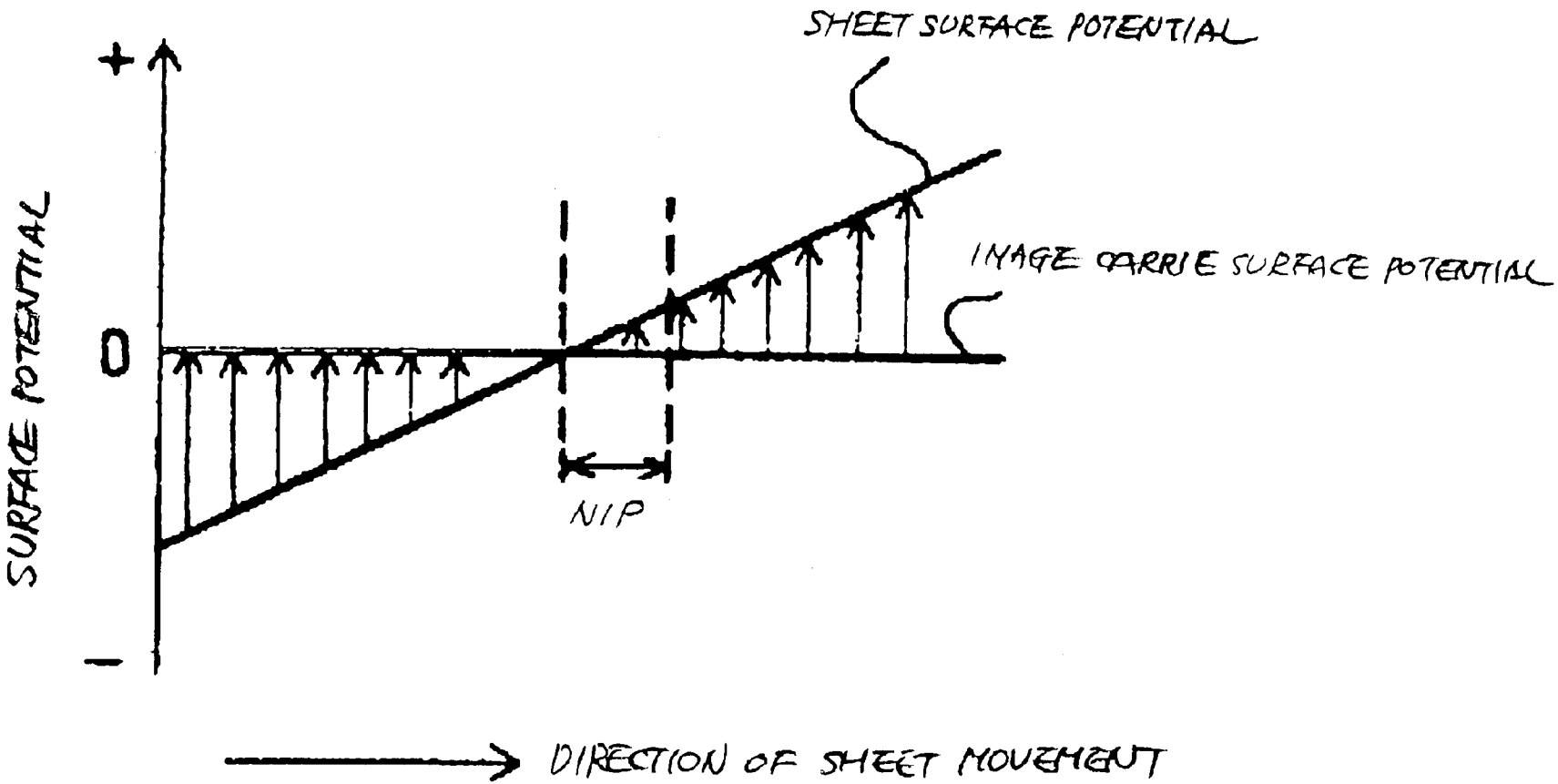
FIG. 3 shows the surface potential of a sheet and the variation of the surface potential of an image carrier.

FIG. 3 shows how the surface potential of the sheet 15 varies with respect to the surface potential of the image carrier 11, which is implemented as an intermediate image transfer body. As shown, at the side upstream of the inlet of the nip where the surface potential of the sheet 15 is negative, an electric field that forces toner toward the image carrier 11 is formed. At the side downstream of the above inlet where the surface potential of the sheet 15 is positive, an electric field that forces toner toward the sheet 15 is formed. In FIG. 3, arrows indicate directions in which toner of negative polarity is subject to the forces of the electric fields. As FIG. 3 indicates, by controlling the biases applied to the first and second bias rollers. 13 and 14, it is possible to bring a potential difference at the inlet of the nip close to zero for thereby reducing discharge and pretransfer.

Figure 4:
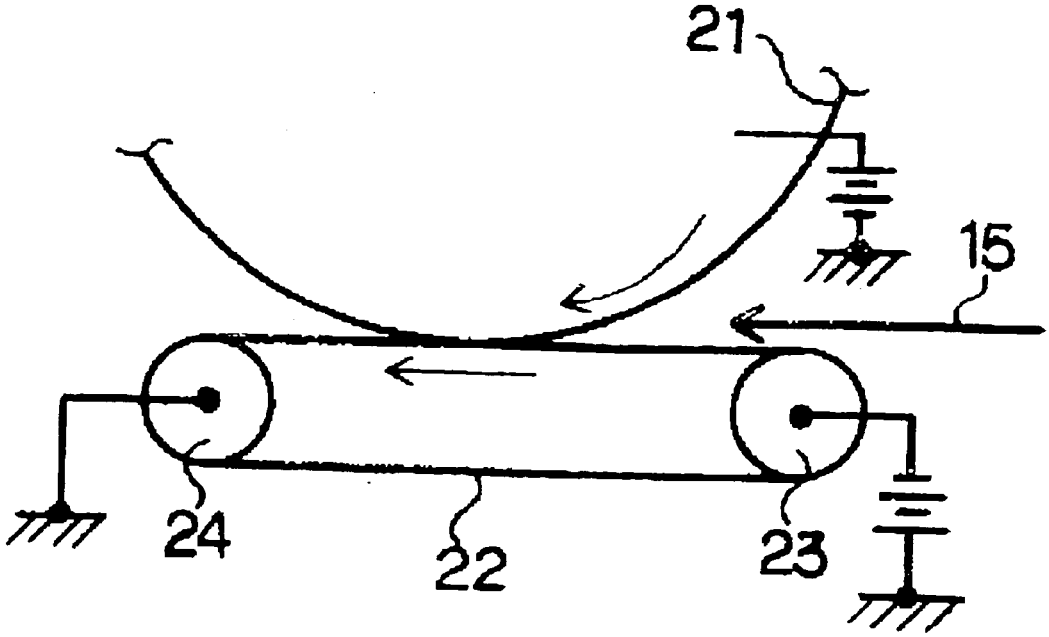
FIGS. 4 through 8 are views each showing another specific configuration of the image transferring section.

A problem particular to image transfer to the sheet 15 is that the characteristic values of the sheet 15, typified by resistance, vary in accordance with the environment. For example, in a humid environment, the electric resistance of the sheet 15 decreases because of moisture absorption with the result that a current flows through the sheet 15. This prevents an adequate electric field from being formed at the nip. FIG. 4 shows another specific configuration of the image transferring section configured to solve the above problem. As shown, when the image carrier 21 comprises an intermediate image transfer body, a bias opposite in polarity to toner is applied to the image carrier 21. At the same time, the first bias roller 23 is provided with the same polarity as toner while the second bias roller 24 is grounded. In this condition, an electric field formed at the image transfer position is free from the influence of a current that flows to the sheet 15 via the toner layer and then leaks, so that the resistance of the sheet 15 is susceptible to the varying environment little.

Figure 5:
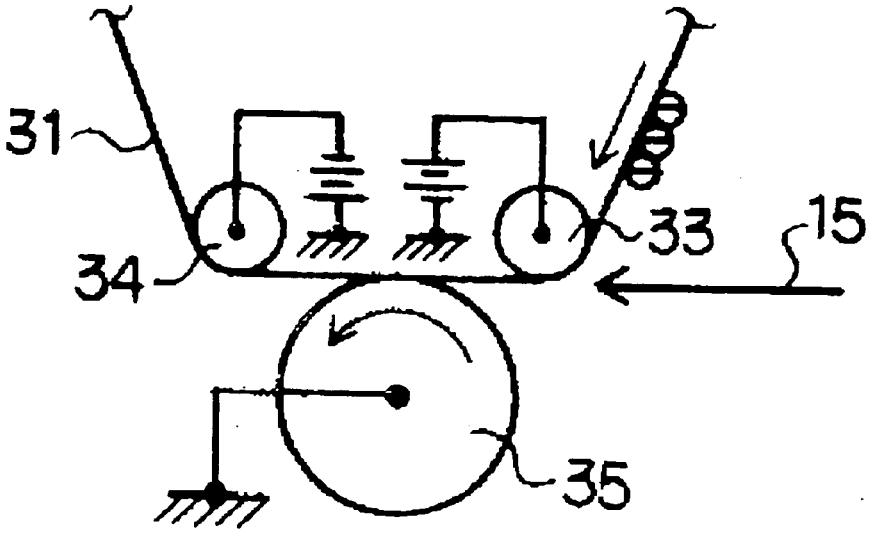

FIG. 5 shows another specific configuration of the image transferring section. As shown, an image carrier 31 is implemented as an intermediate image transfer belt passed over a first and a second bias roller 33 and 34. A bias opposite in polarity to toner is applied to the first bias roller 33 while a bias of the same polarity as toner is applied to the second bias roller 34. Means for applying such biases each may be implemented as a brush or a blade or a combination thereof. An image transfer roller 35 is held in contact with the belt 31 and grounded.

Figure 6:
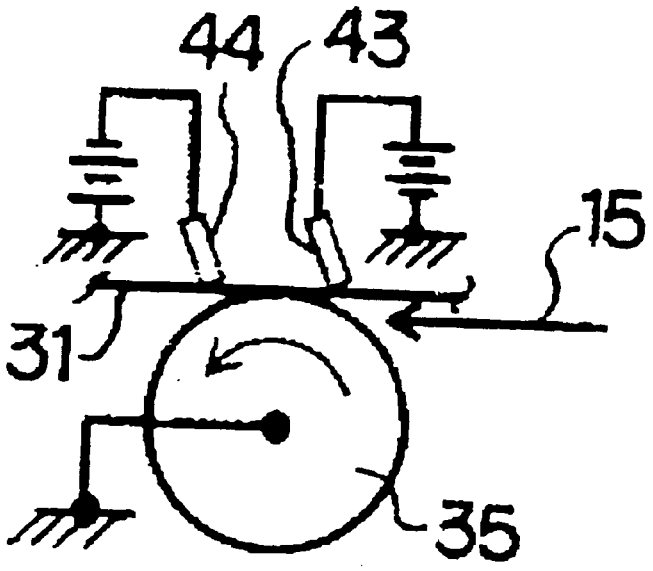

FIG. 6 shows still another specific configuration of the image transferring section. As shown, blades 43 and 44 are used as first and second voltage applying means, respectively. The blades 43 and 44, as distinguished from rollers, need a minimum of space and therefore promote the size reduction of an image forming apparatus.

The intermediate image transfer belt included in the configuration of FIG. 5 has volumetric resistivity of about 8E9 Ω·cm. When voltages of +1 kV and −2 kV were respectively applied to the first and second bias rollers, the surface potential of the belt was measured to be substantially zero at the inlet of the nip. This configuration differs from the configuration of FIG. 3 in that it forms a desired electric field by controlling the surface potential of the belt or image carrier. This is why the surface potential of the belt is brought close to zero at the nip. However, the object is to make the potential difference between the surface of the sheet and that of the image carrier zero. It follows that when a sheet with a different surface potential enters the nip, voltages to be applied to the first and second bias rollers 33 and 34 must be determined in accordance with the surface potential of the sheet.

In a low temperature, low humidity environment in which a sheet is easily charged by friction, the surface potential of a sheet sometimes rise due to frictional charge between the sheet and rollers, although not observed in the above experimental environment. For example, when rollers are implemented as a pair of rubber rollers belonging to a negative frictional charge series, the rollers are frictionally charged to negative polarity while a sheet is charged to positive polarity. If a sheet with excessive charge, for example, enters the nip, then the effect of the electric fields formed by the two bias rollers 33 and 34 is reduced. In light of this, there may be effectively used auxiliary means, e.g., correcting the biases by measuring the surface potential of a sheet just before the sheet enters the nip or using rollers sparingly chargeable by friction or discharging a sheet just before it enters the nip.

Toner comprises mother grains formed of binder resin containing a colorant and, if necessary, a charge control agent, a parting agent and other substances. Further, additives are coated on the mother grains, as needed. Because the present invention is free from limitations on toner, any one of conventional binder resins is usable. Binder resins include polystyrene, styrene-butadien copolymer, styrene-vinyl chloride copolymer, styrene-acrylate copolymer, styrene-metacrylate copolymer, acrylic resin, polyester resin, epoxy resin, polyol resin, rosin-modified maleic resin, phenol resin, polyethylene with low molecular weight, polypropylene with low molecular weight, polyurethane resin, ketone resin, ethylene-ethylacrylate copolymer, polybutyral, and silicone resin. Such binder resins may be used either singly or in combination. As for colorant, any one of conventional dyes and pigments is usable.

As for the charge control agent, nigrosine dye, chromium-containing complex or quaternary ammonium salt, for example, is used in matching relation to the polarity of toner grains. In the case of color toner, there should preferably be used an achromatic or a light-color charge control agent not effecting tonality, e.g., salicylic metal salt or a metal salt of salicylic acid derivative. A parting agent may be added to the toner in order to promote parting of toner from a fixing member and to enhance fixation. As for the method of producing toner, the present invention is practicable with any one of conventional methods including pulverization, polymerization and encapsulation. Experiments were conducted with toner mainly produced by pulverization and having a mean grain size of 6.8 $\mu$m. It was found that even when use was made of spherical toner produced by polymerization and lowered in cohesion due to the coating of additives, the present invention successfully reduced the degree of toner scattering.

Figures 8, 9:
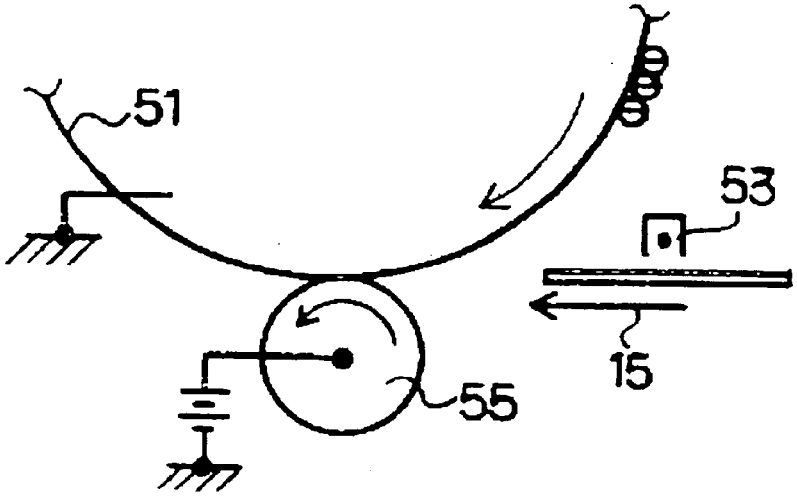
FIG. 9 is a table comparing a conventional technology and present invention as to sharpness, tonality and granularity of an image.

To estimate improvement in image quality, toner scattering from the edges of line images was observed while sharpness, tonality and granularity were measured. The present invention improved toner scattering from the edges of line images to a noticeable degree. FIG. 9 lists the measured values of sharpness, tonality and granularity. For estimation, the configuration shown in FIG. 5 was used. It is to be noted that sharpness was estimated in terms of the MTF (Modulation Transfer Function) of a line pair image having a spatial frequency of 112 lines/mm, and that tonality was estimated in terms of linearity for input image data representative of a gray scale image, i.e., contribution ratio at the time of linear return.

Figure 7:
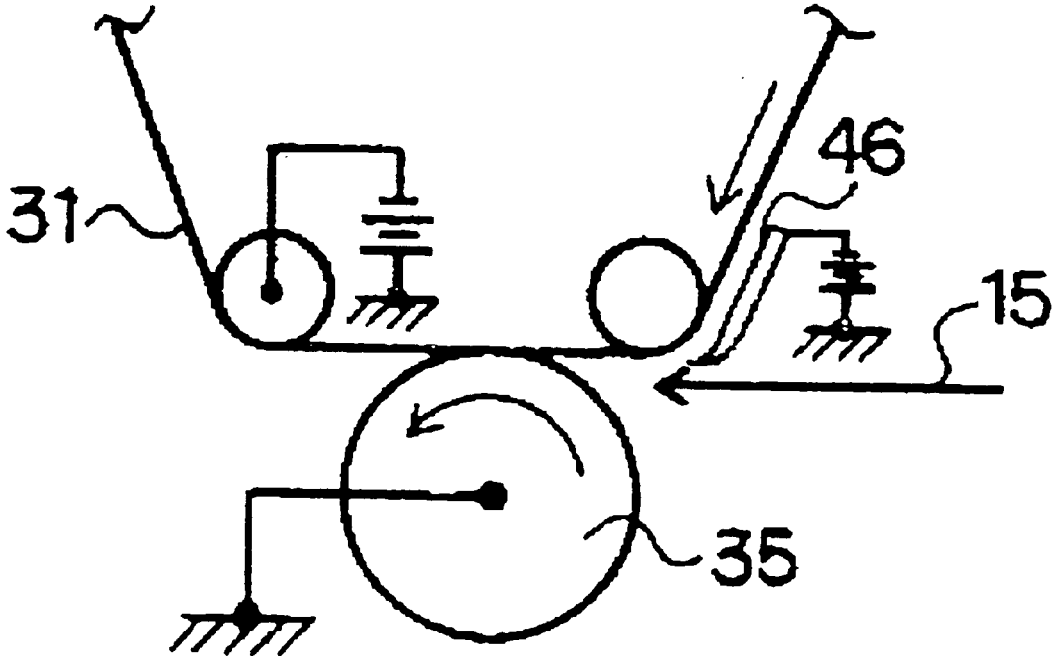

FIG. 7 shows yet another specific configuration of the image transferring section. As shown, a flat, bias applying member 46 is positioned upstream of the nip where the intermediate image transfer body 31 and sheet 15 contact each other. The bias applying member 46 is so positioned as to intervene between the surface of the image transfer body 31 and that of the sheet 15. This configuration allows an electric field, which forces toner toward the image transfer body 31, to be formed without being influenced by the surface potential of the sheet 15.

FIG. 8 shows a further specific configuration of the image transferring section configured to control the surface potential of the sheet 15. The surface potential of the sheet 15 at the inlet of the nip is an important factor, as stated earlier. In the configuration of FIG. 8, an image transfer roller 55 is used as bias applying means while an electric field, forcing toner toward an intermediate image transfer body 51, is formed by charging the sheet surface to the same polarity as toner before it enters the nip. Charging means is implemented as a corona charger 53 although it maybe implemented as, e.g., a roller, a brush or a blade. Further, to reduce the number of parts, a registration roller may be used as a charging member. Because the configuration of FIG. 8 is likely to cause the surface potential of the sheet 15 to vary due to the variation of environment-dependent resistance, a sheet bank, for example, may be configured to constantly control the moisture of sheets.

In summary, it will be seen that the present invention provides an image forming apparatus having various unprecedented advantages, as enumerated below.

(1) Electric fields formed at positions upstream and downstream of a nip for image transfer protect a toner image from degradation ascribable to pretransfer and discharge to occur at the inlet of the nip.

(2) First and second voltage applying means are positioned at the reverse surface of a recording medium support member, i.e., an image transfer member that conveys a recording medium in cooperation with an image carrier. This is also successful to form the above electric fields.

(3) When the image transfer member for transferring a toner image to a recording medium is implemented as a belt, rollers, supporting the belt, are implemented as a first and a second bias roller. This reduces the number of parts for thereby simplifying the construction.

(4) By using a brush as a bias-applying member, it is possible to establish nip pressure uniform enough to reduce irregularity in bias.

(5) By using a blade as a bias applying means, a simple mechanism suffices to apply a bias while saving space.

(6) A roller, a brush and a blade may be used in combination as a bias applying means in order to promote free layout.

(7) A bias applying means, intervening between an image carrier and a recording medium at the inlet of the nip, allows a desired electric field to be formed at a position upstream of the nip without regard to the charged state of the recording medium.

(8) By charging a recording medium to the same polarity as toner before it enters the nip, it is possible to form an electric field, which forces toner toward the image carrier, at the position upstream of the nip. This is also successful to obviate image degradation ascribable to pretransfer and discharge.

(9) When a charge applying means is implemented as a roller bifunctioning to convey a recording medium, the construction is further simplified.

(10) By using a brush as a charge applying member, it is possible to establish nip pressure uniform enough to reduce irregularity in bias.

(11) By using a blade as a charge applying means, a simple mechanism suffices to apply a bias while saving space.

(12) By using a corona charger as a charge applying means, it is possible to charge a recording medium with a simple configuration.

(13) By assigning the function of a charge applying member to a registration roller, it is possible to further simplify the construction.

(14) By using an intermediate image transfer body as an image carrier, it is possible to reduce toner scattering in a color image produced on the intermediate image transfer body.

(15) First and second voltage applying means are positioned at the reverse surface of the intermediate image transfer body so that the electric fields mentioned earlier can be formed against pretransfer and discharge.

(16) When use is made of an intermediate image transfer belt, rollers, supporting the belt, are implemented as a first and a second bias roller. This also reduces the number of parts for thereby simplifying the construction.

(17) By using a brush as a bias applying member, it is possible to establish nip pressure uniform enough to reduce irregularity in bias. This is also true when a blade is used as a bias applying means.

(18) A roller, a brush and a blade may be combined as a bias applying means for promoting free layout.

Various modifications will become possible for those skilled in the art after receiving the teachings of the present disclosure without departing from the scope thereof.

What is claimed is:

1. An image forming apparatus comprising:

an image carrier on which a toner image is to be formed;

a recording medium support member configured to convey a recording medium, carrying the toner image thereon, in cooperation with said image carrier; and a voltage applying device interposed between a surface of said image carrier and a surface of the recording medium and configured to apply a voltage identical in polarity with a toner.

wherein said image carrier and said recording medium support member are driven such that the surface of said image carrier and the surface of said recording medium support member move in a same direction as each other, as seen at a contact position where the surfaces contact each other via the recording medium, said voltage applying device is positioned upstream of the contact position in a direction of movement of said recording medium, and an electric field, forcing the toner image toward said image carrier, and an electric field, forcing said toner image toward the recording medium, are formed between the surface of said image carrier and the surface of said recording medium at positions upstream and downstream, respectively, of the contact position in a direction of movement of said recording medium.

2. An image forming apparatus comprising:

an image carrier on which a toner image is to be formed; and a recording medium support member configured to convey a recording medium, carrying the toner image thereon, in cooperation with said image carrier;

a first voltage applying device; and a second voltage applying device, wherein said image carrier and said recording medium support member are driven such that the surface of said image carrier and the surface of said recording medium support member move in a same direction as each other, as seen at a contact position where the surfaces contact each other via the recording medium, said image carrier comprises an intermediate image transfer body to which toner images are sequentially transferred one above the other to complete a composite image, said first voltage applying device is configured to apply a voltage opposite in polarity to a toner to part of a reverse surface of said intermediate image transfer body upstream of a contact position in a direction of movement of a surface of said intermediate image transfer body, said second voltage applying device is configured to apply a voltage identical in polarity to the toner to part of the reverse surface of said intermediate image transfer body positioned at or downstream of the contact position in the direction of movement of said surface, and an electric field, forcing the toner image toward said image carrier, and an electric field, forcing said toner image toward the recording medium, are formed between the surface of said image carrier and the surface of said recording medium at positions upstream and downstream, respectively, of the contact position in a direction of movement of said recording medium.

3. The apparatus as claimed in claim 2, wherein said recording medium support member comprises a belt passed over a plurality of rollers, and said first voltage applying device and said second voltage applying device comprise rollers.

4. The apparatus as claimed in claim 2, wherein said recording medium support member comprises a belt passed over a plurality of rollers, and said first voltage applying device and said second voltage applying device each comprises a brush.

5. The apparatus as claimed in claim 2, wherein said recording medium support member comprises a belt passed over a plurality of rollers, and said first voltage applying device and said second voltage applying device each comprises a blade.

6. The apparatus as claimed in claim 2, wherein said recording medium support member comprises a belt passed over a plurality of rollers, and said first voltage applying device and said second voltage applying device comprise a combination of two of a roller, a brush and a blade.

7. The apparatus as claimed in claim 2, wherein said intermediate image transfer body comprises a belt passed over a plurality of rollers, and said first voltage applying device and said second voltage applying device comprise rollers.

8. The apparatus as claimed in claim 2, wherein said intermediate image transfer body comprises a belt passed over a plurality of rollers, and said first voltage applying device and said second voltage applying device each comprises a brush.

9. The apparatus as claimed in claim 2, wherein said intermediate image transfer body comprises a belt passed over a plurality of rollers, and said first voltage applying device and said second voltage applying device each comprises a blade.

10. The apparatus as claimed in claim 2, wherein said intermediate image transfer body comprises a belt passed over a plurality of rollers, and said first voltage applying device and said second voltage applying device comprise a combination of two of a roller, a brush and a blade.

11. An image forming apparatus comprising:

image carrier means on which a toner image is to be formed;

recording medium support means for conveying a recording medium, carrying the toner image thereon, in cooperation with said image carrier means; and voltage applying means interposed between a surface of said image carrier means and a surface of the recording medium, wherein said image carrier means and said recording medium support means are driven such that the surface of said image carrier means and the surface of said recording medium support means move in a same direction as each other, as seen at a contact position where the surfaces contact each other via the recording medium, said voltage applying means for applying a voltage identical in polarity with a toner are positioned upstream of the contact position in a direction of movement of said recording medium, and an electric field, forcing the toner image toward said image carrier means, and an electric field, forcing said toner image toward the recording medium, are formed between the surface of said image carrier means and the surface of said recording medium at positions upstream and downstream, respectively, of the contact position in a direction of movement of said recording medium.

12. An image forming apparatus comprising:

image carrier means on which a toner image is to be formed;

recording medium support means for conveying a recording medium, carrying the toner image thereon, in cooperation with said image carrier means;

first voltage applying means; and second voltage applying means, wherein said image carrier means and said recording medium support means are driven such that a surface of said image carrier means and a surface of said recording medium support means move in a same direction as each other, as seen at a contact position where the surfaces contact each other via the recording medium, said image carrier means comprises an intermediate image transfer body to which toner images are sequentially transferred one above the other to complete a composite image, said first voltage applying means for applying a voltage opposite in polarity to a toner to part of a reverse surface of said intermediate image transfer body are positioned upstream of the contact position in a direction of movement of a surface of said intermediate image transfer body;

said second voltage applying means for applying a voltage identical in polarity to the toner to part of the reverse surface of said intermediate image transfer body are positioned at or downstream of the contact position in the direction of movement of said surface, and an electric field, forcing the toner image toward said image carrier means, and an electric field, forcing said toner image toward the recording medium, are formed between the surface of said image carrier means and the surface of said recording medium at positions upstream and downstream, respectively, of the contact position in a direction of movement of said recording medium.

13. The apparatus as claimed in claim 12, wherein said recording medium support means comprises a belt passed over a plurality of rollers, and said first voltage applying means and said second voltage applying means comprise rollers.

14. The apparatus as claimed in claim 12, wherein said recording medium support means comprises a belt passed over a plurality of rollers, and said first voltage applying means and said second voltage applying means each comprises a brush.

15. The apparatus as claimed in claim 12, wherein said recording medium support means comprises a belt passed over a plurality of rollers, and said first voltage applying means and said second voltage applying means each comprises a blade.

16. The apparatus as claimed in claim 12, wherein said recording medium support means comprises a belt passed over a plurality of rollers, and said first voltage applying means and said second voltage applying means comprise a combination of two of a roller, a brush and a blade.

17. The apparatus as claimed in claim 12, wherein said intermediate image transfer body comprises a belt passed over a plurality of rollers, and said first voltage applying means and said second voltage applying means comprise rollers.

18. The apparatus as claimed in claim 12, wherein said intermediate image transfer body comprises a belt passed over a plurality of rollers, and said first voltage applying means and said second voltage applying means each comprises a brush.

19. The apparatus as claimed in claim 12, wherein said intermediate image transfer body comprises a belt passed over a plurality of rollers, and said first voltage applying means and said second voltage applying means each comprises a blade.

20. The apparatus as claimed in claim 12, wherein said intermediate image transfer body comprises a belt passed over a plurality of rollers, and said first voltage applying means and said second voltage applying means comprise a combination of two of a roller, a brush and a blade.

21. An image forming method comprising the steps of:

forming a toner image on an image carrier;

causing said image carrier and a recording medium support member to convey the recording medium, carrying the toner image thereon, by nipping said recording medium;

driving said image carrier and said recording medium support member such that a surface of said image carrier and a surface of said recording medium support member move in a same direction as each other, as seen at a contact position where the surfaces contact each other via the recording medium; and applying a voltage to a device interposed between a surface of said image carrier and a surface of the recording medium configured identical in polarity with the toner, said device located at a position upstream of the contact position in a direction of movement of said recording medium.

* * * * *